US006241539B1

(12) United States Patent
Sato et al.

(10) Patent No.: US 6,241,539 B1
(45) **Date of Patent: *Jun. 5, 2001**

(54) CONNECTOR DRIVING APPARATUS FOR DRIVING A PLURALITY OF CONNECTORS RELATIVELY TO A PLURALITY OF MATING CONNECTORS

(75) Inventors: Kazuomi Sato, Tokorozawa; Hisashi Ishida, Tokyo, both of (JP)

(73) Assignee: Japan Aviation Electronics Industry, Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,023

(22) Filed: Feb. 18, 1999

(30) Foreign Application Priority Data

Feb. 19, 1998 (JP) ..... 10-037581

(51) Int. Cl.[7] ..... H01R 13/62
(52) U.S. Cl. ..... 439/157; 439/347
(58) Field of Search ..... 439/157, 310, 439/347, 152, 701, 153, 155

(56) References Cited

U.S. PATENT DOCUMENTS 5,795,174 * 8/1998 Saito et al. ..... 439/310
6,149,447 * 11/2000 Maeda et al. ..... 439/157

* cited by examiner

*Primary Examiner*—Hien Vu
*Assistant Examiner*—Ross Gushi
(74) *Attorney, Agent, or Firm*—Laff, Whitesel & Saret, Ltd.; J. Warren Whitesel

(57) ABSTRACT

In order to drive connectors relatively to mating connectors in a housing for connection and disconnection of the connectors with the mating connectors, the connectors have projections thereon which projects outside of the housing when received in the housing, and a slider is slidably mounted on the housing and having a groove with a cam portion for receiving the projection. When the slider is pulled or pushed, the projection is driven by the cam portion of the groove to drive the connectors. Partitions are mounted in the housing to partition an inner space of the housing into a plurality of rooms for accommodating the connectors so as to separate between adjacent connectors by the partition. Each of the partition has engaging projections engaged with engaging holes formed in the housing wall. One of the engaging holes is registry with the groove of the slider so that the corresponding one of the engaging projection is also received in the groove at the projecting end through the engaging hole. The slider is also provided with a slot for receiving the other engaging projection projecting through the other corresponding engaging hole. Thus, the slider, if it is made with small size, has a desired mechanical strength and can be smoothly moved.

6 Claims, 13 Drawing Sheets

CONNECTOR DRIVING APPARATUS FOR DRIVING A PLURALITY OF CONNECTORS RELATIVELY TO A PLURALITY OF MATING CONNECTORS

BACKGROUND OF THE INVENTION

This invention relates to a connector driving apparatus for driving a plurality of connectors relatively to a plurality of mating connectors in the housing so as to perform connection and disconnection of the plurality of connectors with the plurality of mating connectors. In particular, the present invention relates to an improvement in size of such a connector driving apparatus.

A conventional one of such a connector driving apparatus comprises a housing for receiving the plurality of connectors and a slider mounted on the housing for driving the plurality of connectors relatively to the plurality of mating connectors. The housing having a plurality of frames defining a space in which the plurality of connectors are arranged one by one therein so that the plurality of connectors are movable in a first direction such as an X-direction. Each of the connectors has a projection which outwardly projects from each connector in a second direction, such as a Y-direction, perpendicular to the X-direction. A particular one of the frames of the housing is formed with a plurality of slits extending in the X-direction for receiving the projections of the plurality of connectors to permit the projections to move in the X-direction. The particular frame is also formed with a plurality of pairs of first and second engaging holes at positions where the slits are not formed. The hole pairs are arranged with predetermined intervals between adjacent ones in a third direction, such as a Z-direction, perpendicular to the X- and Y-directions. The first hole and the second hole of each of the hole pair are separated at a predetermined distance in the X-direction.

Further, the housing has a plurality of partitions for partitioning a space in the housing into a plurality of rooms and are arranged parallel to each other in the Z-direction, so that each of the rooms accommodates one or a predetermined number of ones of the plurality of the connectors. Herein, each of the partitions has a pair of first and second engaging projections which are engaged with the first and second engaging holes, respectively, to fix itself into the housing.

On the other hand, the slider is mounted on the particular frame to be slidable in the Z-direction. The slider has a groove and first and second engaging slots. More particularly, the groove is for receiving the projections of the connector projecting through the slits of the particular frame while the first and second engaging slots receiving the first and second engaging projections projecting through the first and second holes of the particular frame. Each of the grooves mainly extends in the Z-direction and has a cam portion at its one end for driving the projections so as to drive the connectors in the X-direction. Besides, the first and second engaging slots all extend in the Z-direction, too. Furthermore, the groove and the first and second engaging slots are arranged independently and apart from each other in the X-direction.

With this structure, the above connection and disconnection are controlled by the operation of the slider. In detail, when the slider is moved in the Z-direction, the cam portions drive the respective projections of the connectors in the X-direction so that the connectors move in the X-direction accordingly.

In the above description, each connector has one projection and, accordingly, the groove is also one As the same manner, each partition has the pair of first and second engaging projections and, accordingly, the first and second engaging slots are all one each.

In another conventional one of such an apparatus, each of the partitions further has another pair of first and second engaging projections at the opposite end in the Y-direction which will be referred to as "first and second opposite engaging holes. The first and second opposite engaging holes are engaged with another pair of first and second engaging holes formed in another one of flame opposite to the particular frame which will be referred to as "first and second opposite engaging holes" and "opposite frame", respetively. In the structure, the partitions are rigidly fixed to the housing. Further, each connector often has another projection oppositely projecting outside the connector in the Y-direction which will be referred to as "opposite projection", an the opposite flame is further provided with slits ending in the X-direcion for receiving and guiding the opposite projections of the connectors. In the structure, the each of the connector can stably be moved in the housing. Herein, an additional slider having a like groove with cam portions is also mounted on the opposite frame so as to drive the opposite projections of the connectors. The connectors can be driven stably in cooperation of the slider and the additional slider. In this structure, the additional slider also has a pair of slots for receiving the first and second opposite engaging projections.

Recently, electrical parts generally require small in size more and more and the connector driving apparatus does also.

However, the conventional driving appaatus is subjected to the restriction of down sizing with the above structure where the groove and the first and second engaging slots are arranged independently and apart from each other. If small-sized, the slider considerably becomes flimsy in strength owing to the structure thereof so that it is difficult that the slider can reliably move the plurality of connectors without destroy.

SUMMARY OF THE INVENTION

It is therefore an object of the present invention to improve the connector driving apparatus with the above structure and, more particularly, to be small-sized with a guarantee relating to the strength thereof.

According to the present invention, a connector driving apparatus comprises a housing and a slider each having the following structure and is for driving a plurality of connectors relatively to a plurality of mating connectors in a first direction so as to perform connection and disconnection of the plurality of connectors with the plurality of mating connectors. Herein, each of the connectors has a projection outwardly projecting therefrom in a second direction perpendicular to the first direction.

In detail, the housing is for fixedly holding therein the plurality of mating connectors arranged one by one in a third direction perpendicular to the first and second directions. Also, the housing is for receiving the plurality of connectors arranged one by one in the third direction so that the plurality of connectors are movable in the first direction relatively to the plurality of mating connectors. Such housing comprises a pair of parallel frames, opposite side blocks and a plurality of partitions.

The pair of parallel frames extend in the third direction and apart from each other in the second direction. Herein, first one of the parallel frames has a plurality of pairs of first and second holes at predetermined positions spaced in the third direction. The first and second holes are positioned spaced from each other in the first direction. Furthermore, the first one of parallel frames has a plurality of slits extending in the first direction for receiving and permitting the projections of the plurality of connectors to be moved therein in the first direction.

The opposite side blocks fixedly connect the parallel frames to each other at opposite ends in the third direction.

Each of the plurality of partitions has a pair of first and second engaging projections on one side thereof. The pair of first and second engaging projections are engaged with a corresponding one of said pairs of first and second holes. And, thereby, the partition are fixed to the first one of the parallel frames to partition a space in the housing into a plurality of rooms arranged in the third direction between the opposite side blocks.

On the other hand, the slider is mounted on the first one of parallel frames and slidable in the third direction. This slider has a groove extending in the third direction for receiving the projections of the plurality of connectors received in the housing. Besides, the groove has a cam portion for driving the projections in the first direction when the slider is moved in the third direction so as to drive the plurality of connectors. Specifically, the groove is in registry with the first holes of the plurality of pairs of first and second holes and receives therein the first engaging projections projecting through the first holes.

With this structure, since the groove also serves for the first engaging slot of the conventional slider, the slider according to the present invention can be small-sized in the first direction so that the strength does not become decrease. Thus, the connector driving apparatus is totally small-sized in the first direction not to be flimsy.

DESCRIPTION OF THE PREFERRED EMBODIMENT

Prior to description of embodiments of this invention, brief description of a connector driving apparatus of the conventional techniques will at first be made for a better understanding of this invention.

Figure 1:
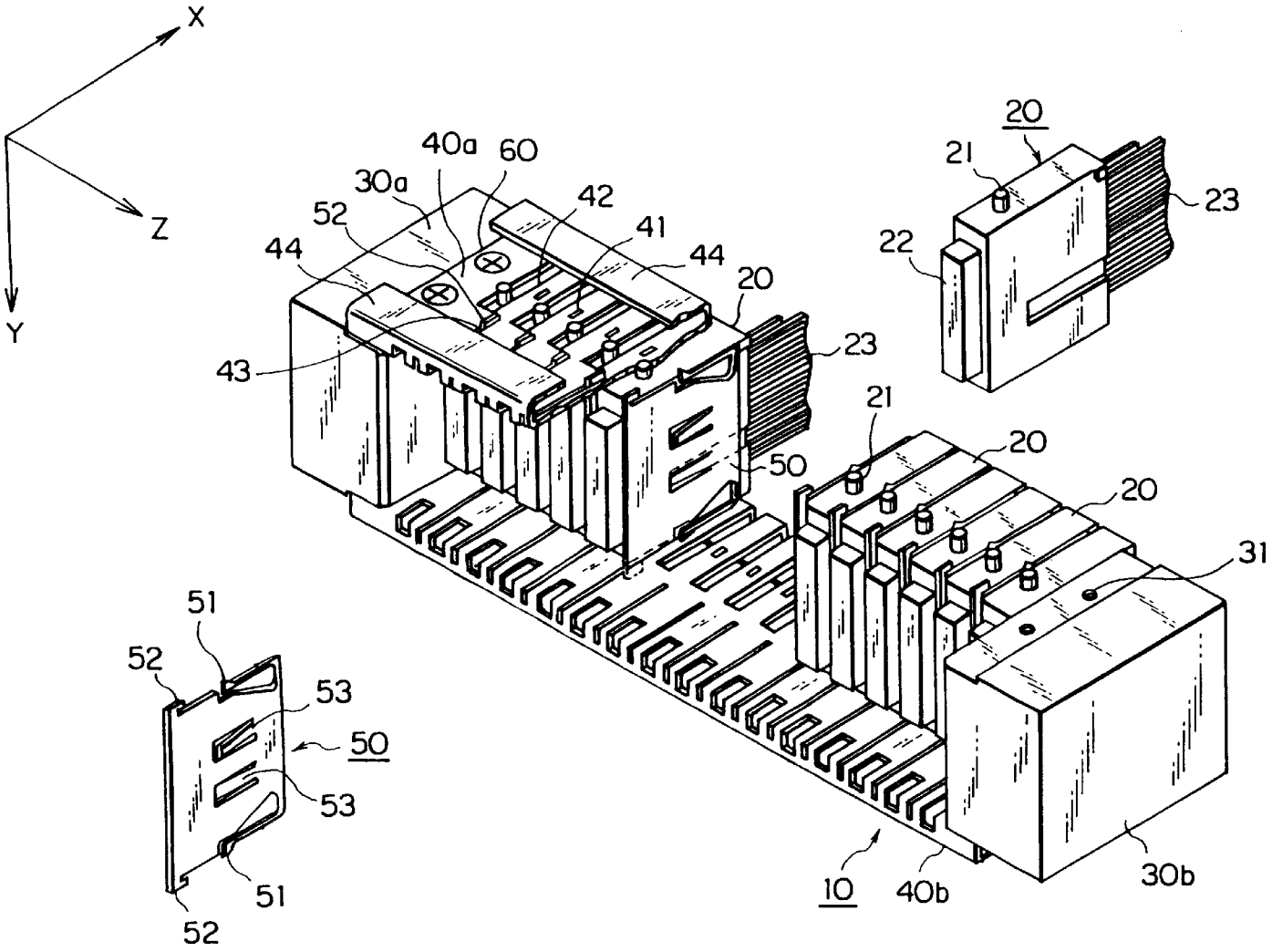
FIG. 1 PRIOR ART
FIG. 1 shows a perspective view of a housing and connectors in a conventional connector driving apparatus.
Figure 2:
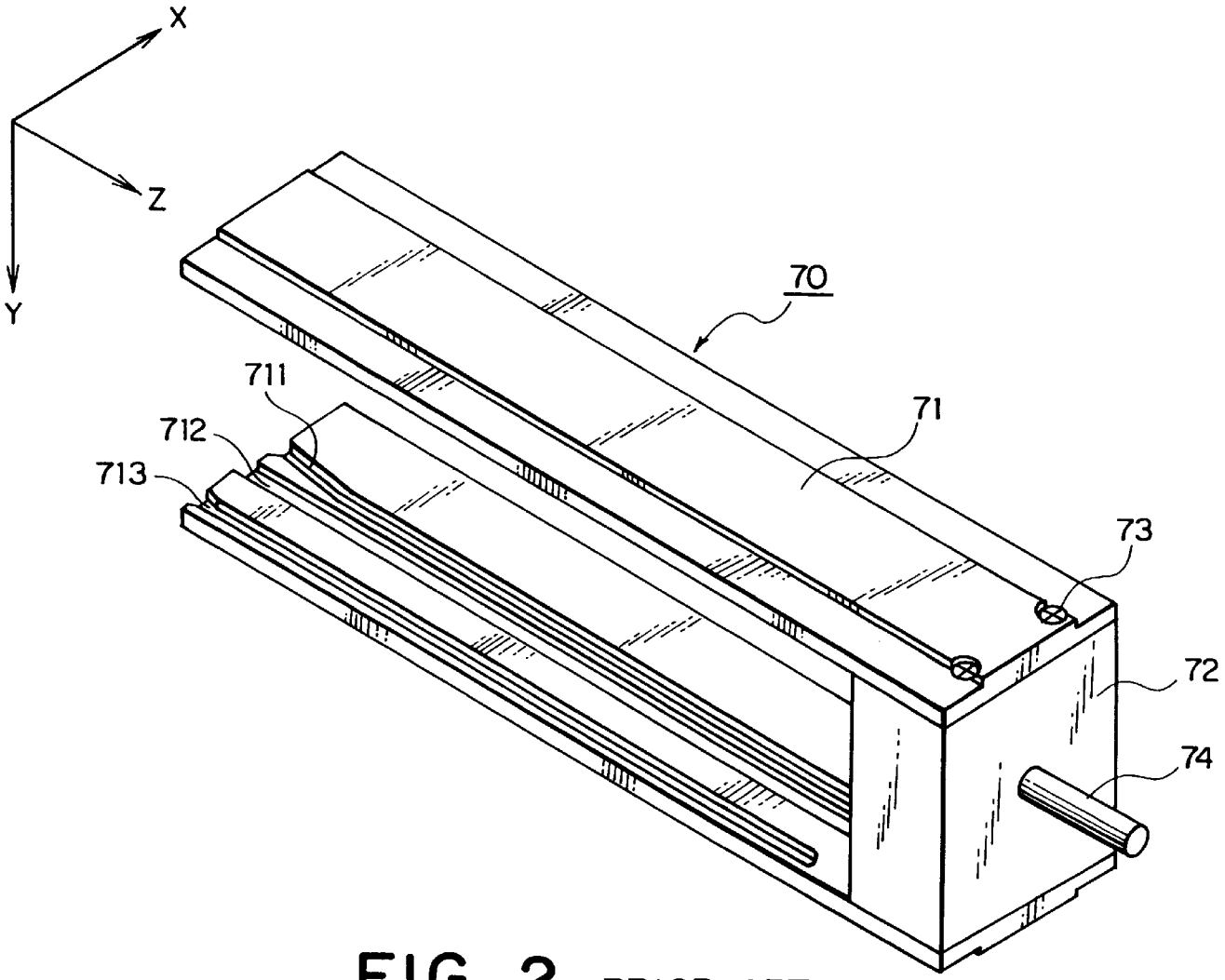
FIG. 2 PRIOR ART
FIG. 2 shows a perspective view of a slider member of the conventional connector driving apparatus.
Figure 3:
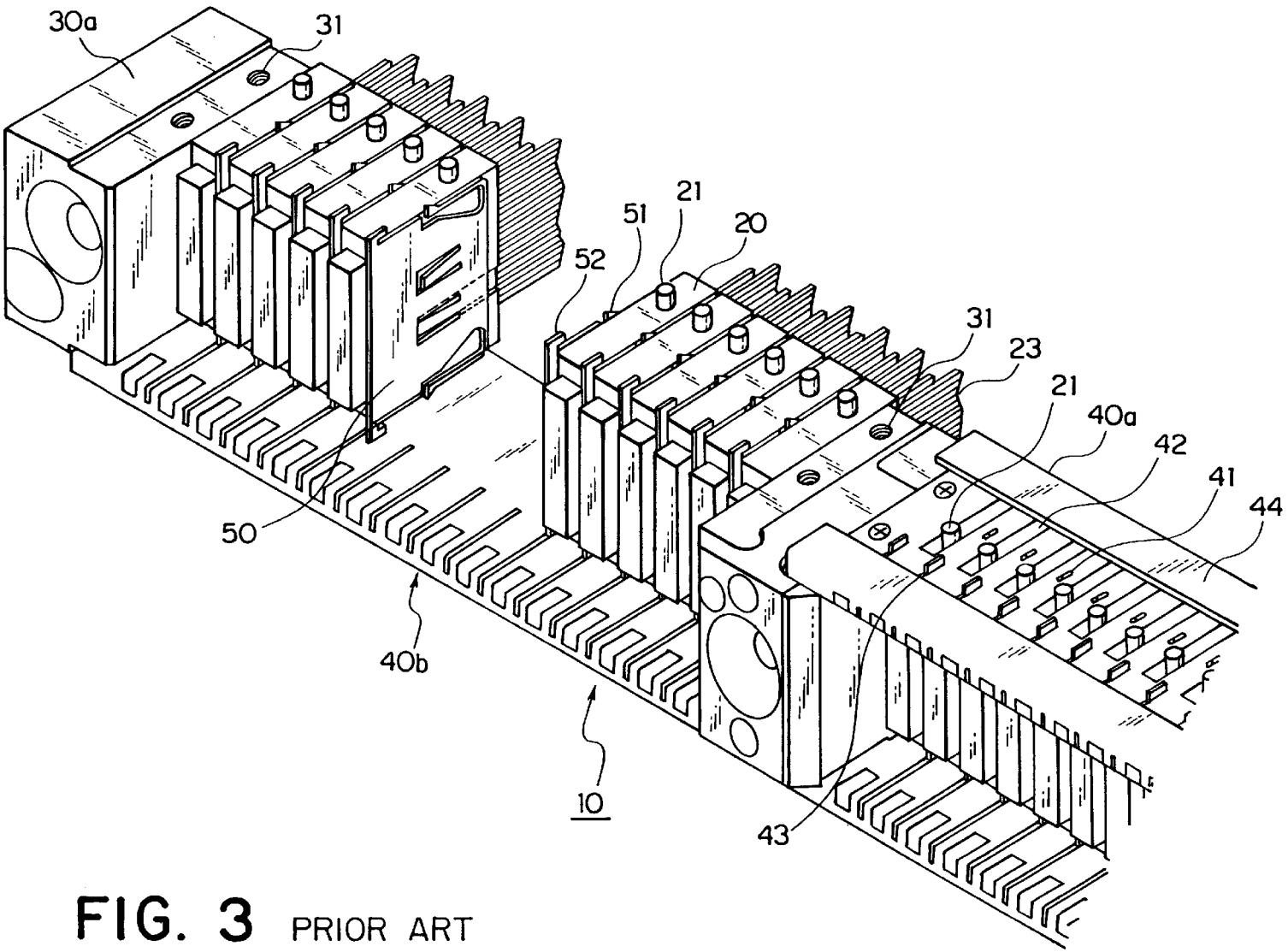
FIG. 3 PRIOR ART
FIG. 3 is a perspective view for use in describing the problem of the conventional apparatus.

Referring to FIGS. 1–3, the conventional apparatus has a housing 10 and a slider member 70 and is for driving a plurality of connectors 20 relatively to a plurality of mating connectors (not shown but corresponding to ones shown at 80 in FIG. 7) in the housing 10. The housing 10 receives the connectors 20 to be moved in an X-direction. Each of the plurality of connectors 20 has two projections 21 which are opposite to each other and outwardly project from each connector 20 in a Y-direction perpendicular to the X-direction. Herein, one of the two projections 21 of each connector 20 is not shown in FIG. 1 Also, the housing 10 is for receiving the plurality of connectors 20 arranged one by one in a Z-direction perpendicular to the X-direction and the Y-direction so that the plurality of connectors 20 are movable in the X-direction relatively to the plurality of mating connectors.

In FIG. 1, the housing 10 of the conventional techniques has opposite side blocks 30*a* and 30*b*, a pair of parallel frames 40*a* and 40*b*, a plurality of partitions 50 while each connector 20 further has an engagement portion 22 and a cable 23.

The pair of parallel frames 40*a* and 40*b* extend in the Z-direction and apart from each other in the Y-direction. Herein, the upper one of the parallel frames 40*a* has a plurality of pairs of first and second holes 41 and 43 at predetermined positions spaced in the Z-direction and, also the lower one of the parallel frames 40*b* does. The first and second holes 41 and 43 are positioned spaced from each other in the X-direction. Furthermore, the upper one of parallel frames 40*a* has a plurality of slits 42 extending in the X-direction for receiving and permitting the projections 21 of the plurality of connectors 20 to be moved therein in the X-direction and, also, the lower one of parallel frames does. Besides, each of the parallel frames 40*a* and 40*b* has U-shaped rails at both edge in the X-direction thereof, so as to movably hold the slider member 70 in the Z-direction, as described later.

The opposite side blocks 30*a* and 30*b* fixedly connect the parallel frames 40*a* and 40*b* to each other at opposite ends in the Z-direction. In detail, each side block 30*a* and 30*b* has screw holes 31 while each parallel frame 40*a* and 40*b* also has respective screw hole (not shown). Beside that, the parallel frames 40*a* and 40*b* are fixed to the opposite side blocks 30*a* and 30*b* with screws 60.

Each of the plurality of partitions 50 has two pair of first and second engaging projections 51 and 52 on opposite edges or ends thereof in the Y-direction, that is, on the upper and lower ends. The first and second engaging projections 51 and 52 are engaged with the corresponding first and second holes 41 and 43, respectively. And, thereby, the partition 50 are fixed to both of the parallel frames 40*a* and 40*b* to partition a space in the housing 10 into a plurality of rooms arranged in the Z-direction between the opposite side blocks 30*a* and 30*b*. Furthermore, each partition 50 has two lances 53 toward different direction from each other. Each lance 53 serves to hold the connector 20 in cooperation with the neighbor lance 53 in the Z-direction.

On the other hand, the slider member 70 as shown in FIG. 2 is movably held thereon by the parallel frames 40*a* and 40*b* and slidable in the Z-direction.

In detail, the illustrated slider member 70 has a pair of parallel slider plates 71 and a slider block 72. The pair of parallel slider plates 71 extend in the Z-direction and apart firm each other in the Y-direction. Furthermore, the parallel slider plates 71 are fixedly connected to each other at one end in the Z-direction by the slider block 72. More specifically, the parallel slider plates 71 are fixed to the slider block 72 with a plurality of screws 73 as illustrated in FIG. 2. Besides, the slider member 70 has a drawer 74 projecting from the slider block 72 and extending in the Z-direction. In operation of the drawer 74, the slider member 70 can slide in the Z-direction.

More in detail, each of parallel slider plates 71 has a groove 711 and first and second engaging slots 712 and 713. The groove 711 mainly extends in the Z-direction to receive the projections 21 of the plurality of connectors 20 when the housing 10 receives the plurality of connectors 20 therein. Besides, the groove 711 has a cam portion for driving the projections in the X-direction when the slider member 70 is moved in the Z-direction so as to drive the plurality of connectors 20. On the other hand, the first and second engaging slots 712 and 713 extend in the Z-direction and are for accommodating or receiving therein the first and second engaging projections 51 and 52 projecting through the first and second holes 41 and 43, respectively.

As readily understood from FIG. 2, the groove 711 and the first and second engaging slots 712 and 713 are arranged independently and apart from each other in the X-direction Therefore, it is difficult for the conventional apparatus to be small-sized with a guarantee relating to the strength and the function thereof Moreover, the difficulty of the conventional apparatus become conspicuous in case that the projection 21 of each connector 20 locates in each one of two positions in the X-direction when the plurality of connectors 20 connect with the plurality of mating connectors, as shown in FIG. 3. In this event, each of the parallel slider plates has two grooves 711 relative to two positions, respectively. Such modification about structure in the conventional techniques promotes the difficulty of being small-sized of the apparatus because both of the two grooves 711 must be independently arranged in the X-direction apart from the first engaging slot 712. Moreover, it should be noted that the number of the groove and slots on the slider plate increases the difficulty about down sizing. Therefore, this invention improves the structure of the apparatus so that number of the groove and slots on the slider plate decreases Now, explanation of a preferred embodiment of this invention will be made with reference to drawings, applying this invention to a connector driving apparatus.

Figure 4:
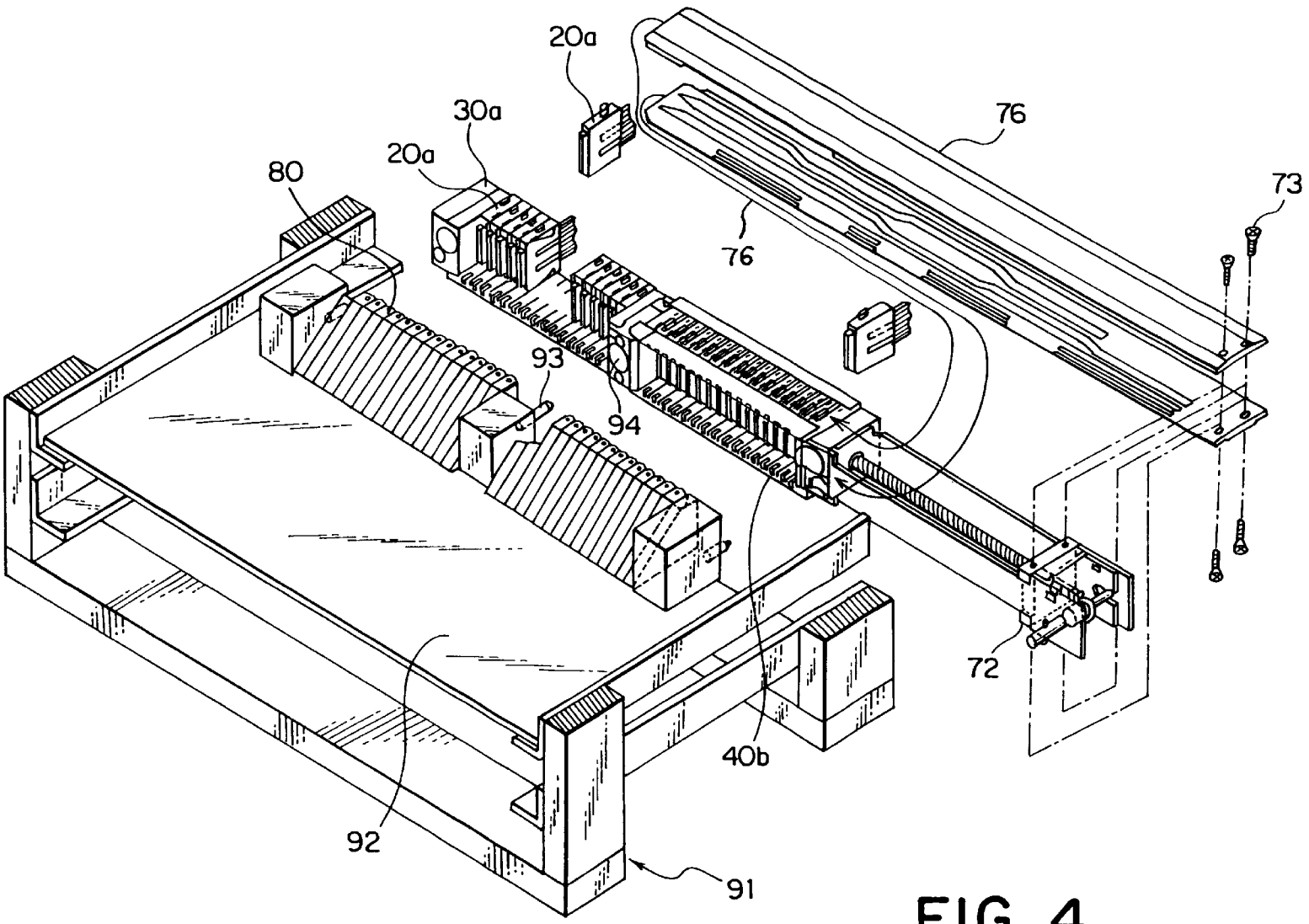
FIG. 4 shows a perspective view of a connector driving apparatus according to a preferred embodiment of this invention.

Referring to FIG. 4, a connector driving apparatus according to the preferred embodiment of this invention is for driving a plurality of connectors 20*a* relatively to a plurality of mating connectors 80 which are arranged on a printed circuit plate 92 attached to a cage 91. The illustrated mating connectors 80 are right-angle connectors, which are divided into two groups. Also, the illustrated connectors 20*a* are divided into two groups. The connector driving apparatus according to preferred embodiment are fitted up with the cage 91 with guide pins 93 guided into respective guiding holes 94 so as to perform connection and disconnection of the plurality of connectors 20*a* with the plurality of mating connectors 80.

Figure 5:
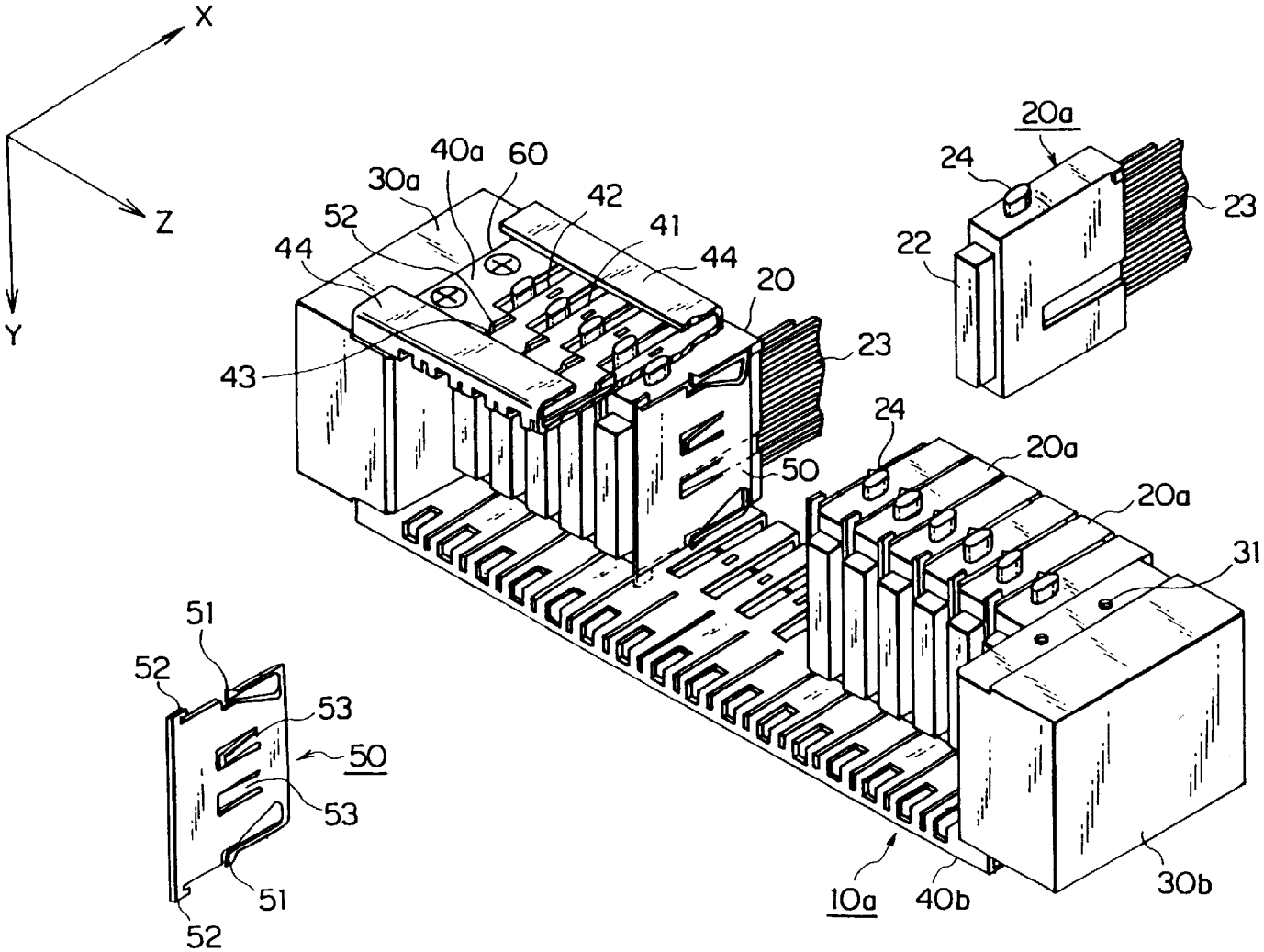
FIG. 5 is a perspective view for use in describing a structure of a housing of the connector driving apparatus of FIG. 4 together with connectors received therein.
Figure 6:
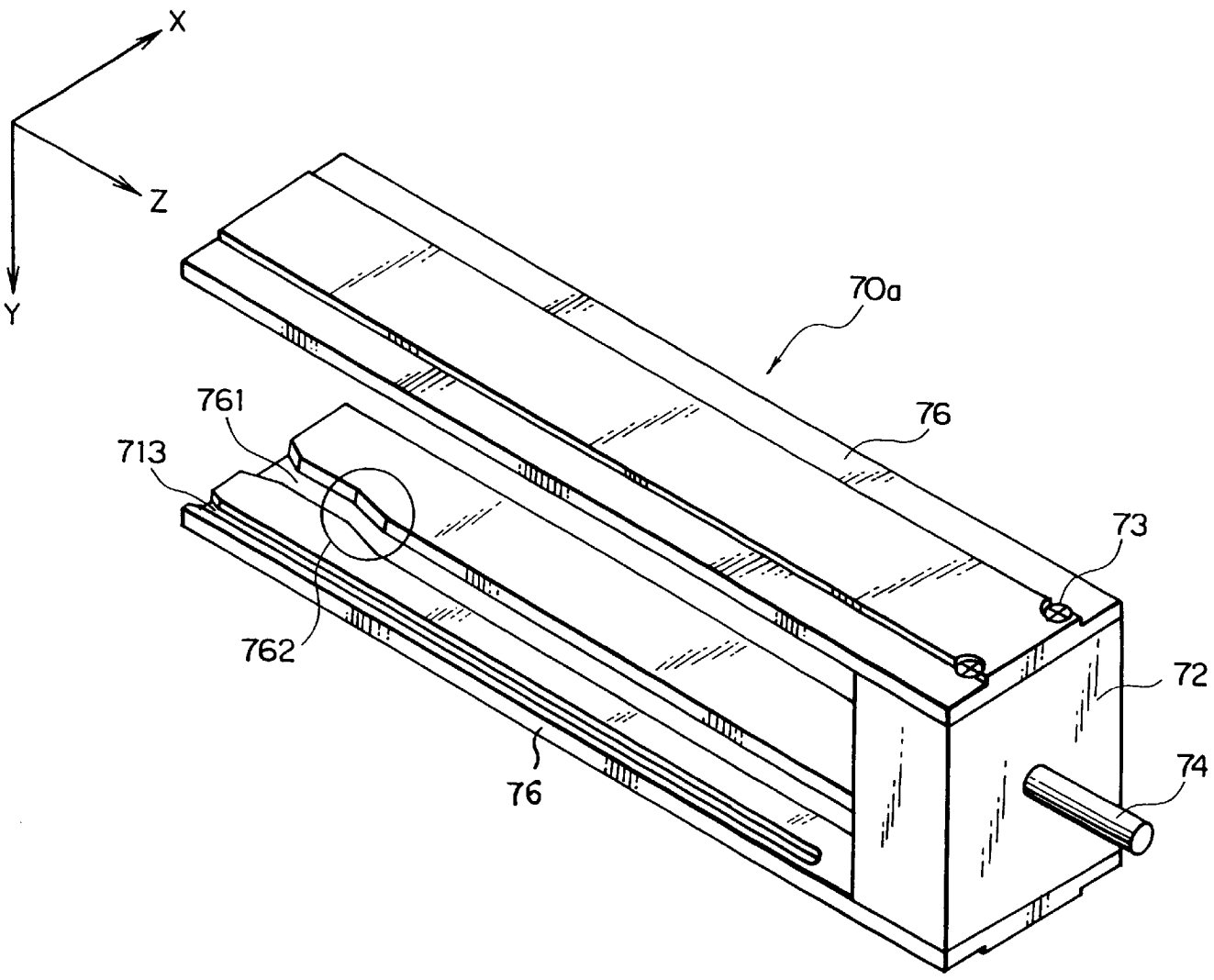
FIG. 6 is a perspective view for use in describing a structure of a slider plate used together with the housing of FIG. 5.

Now, for easily understanding, detail description about structure of the connector driving apparatus according to this invention with reference to FIGS. 5 and 6.

Referring to FIG. 5, a housing 10 of the present invention has opposite side blocks 30*a* and 30*b*, a pair of parallel frames 40*a* and 40*b*, a plurality of partitions 50 while each connector 20*a* has two projections 24, an engagement portion 22 and a cable 23. The two projections 24 of each connector 20*a* are opposite to each other and outwardly project from each connector 20*a* in the Y-direction. Herein, one of the two projections 24 of the connector 20*a* is not shown in FIG. 5. Specifically, each projection 24 has a particular shape where the each projection 24 has different sizes in the X- and Z-directions, from each other. Concretely, the particular shape is approximately elliptical shape which has a long axis in the X-direction.

The parallel frames 40*a* and 40*b* extend in the Z-direction and apart from each other in the Y-direction. Herein, the upper one of the parallel frames 40*a* has a plurality of pairs of first and second holes 41 and 43 at predetermined positions spaced in the Z-direction and, also, the lower one of the parallel frames 40*b* does. The first and second holes 41 and 43 are positioned spaced from each other in the X-direction. Furthermore, the upper one of parallel frames 40*a* has a plurality of slits 42 extending in the X-direction for receiving and permitting the projections 24 of the plurality of connectors 20*a* to be moved therein in the X-direction and, also, the lower one of parallel frames 40*d* does. Besides, each of the parallel frames 40*a* and 40*b* has U-shaped rails at both edge in the X-direction thereof, so as to movably hold the slider in the Z-direction, as described later.

The opposite side blocks 30*a* and 30*b* fixedly connect the parallel frames 40*a* and 40*b* to each other at opposite ends in the Z-direction. In detail, each side block 30*a* and 30*b* has screw holes 31 while each parallel frame 40*a* and 40*b* also has respective screw hole (not shown). Beside that, the parallel frames 40*a* and 40*b* are fixed to the opposite side blocks 30*a* and 30*b* with screws 60.

Each of the plurality of partitions 50 has two pair of first and second engaging projections 51 and 52 on opposite side thereof in the Y-direction. The fist and second engaging projections 51 and 52 are engaged with the corresponding first and second holes 41 and 43, respectively. And, thereby, the partition 50 are fixed to both of the parallel frames 40*a* and 40*b* to partition a space in the housing 10 into a plurality of rooms arranged in the Z-direction between the opposite side blocks 30*a* and 30*b*. Furthermore, each partition 50 has two lances 53 toward different direction from each other. Each lance 53 serves to hold the connector 20*a* in cooperation with the neighbor lance 53 in the Z-direction.

On the other hand, the slider member 70*a* of this invention is movably held by the parallel frames 40*a* and 40*b* and slidable in the Z-direction, as illustrated in FIG. 6.

In detail, the illustrated slider member 70*a* has a pair of parallel slider plates 76 and a slider block 72. The pair of parallel slider plates 76 extend in the Z-direction and apart from each other in the Y-direction. Furthermore, the parallel slider plates 76 are fixedly connected to each other at one end in the Z-direction by the slider block 72. More specifically, the parallel slider plates 76 are fixed to the slider block 72 with a plurality of screws 73, as shown in FIG. 6. Besides, the slider member 70*a* has a drawer 74 projecting from the slider block 72 and extending in the Z-direction. In operation of the drawer 74, the slider member 70*a* can slide in the Z-direction.

More in detail, each of parallel slider plates 76 has a groove 761 and an engaging slot 713. The groove 761 mainly extends in the Z-direction to receive the projections 24 of the plurality of connectors 20*a* when the housing 10 receives the plurality of connectors 20*a* therein. Besides, the groove 711 has a cam portion 762 for driving the projections 24 in the X-direction when the slider member 70*a* is moved in the Z-direction so as to drive the plurality of connectors 20*a*.

More specifically, the groove 761 can serve for the first engaging slot of the conventional slider member 70 illustrated in FIG. 2. The groove 761 is in registry with the first holes 41 of the parallel frames 40*a* and 40*b* and receives therein the first engaging projections 51 projecting through the first holes 41. Herein, the engaging slot 713 extends in the Z-direction and is for receiving therein the second engaging projections 52 projecting through the second holes 43.

The following explanation will be made about the operation of connection and disconnection of the connector 20*a* with the mating connector 80, with reference to FIGS. 7 through 10.

Figure 7:
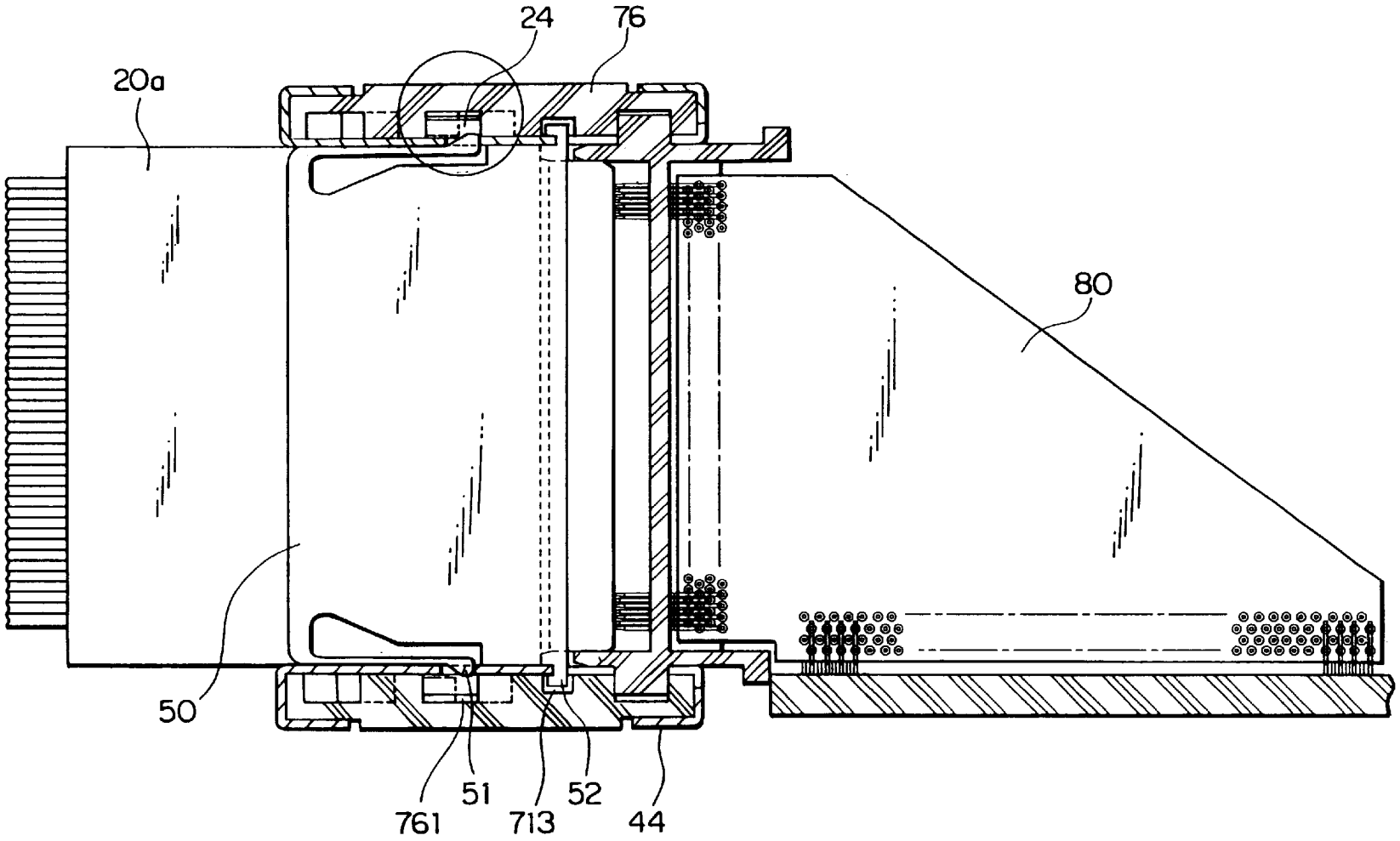
FIG. 7 is a sectional view of the connector driving apparatus of FIG. 4 for use in describing a relationship among the housing, a slider plate, a partition, the connector, and a mating connector, where the connector is separated from the mating connector.
Figure 8:
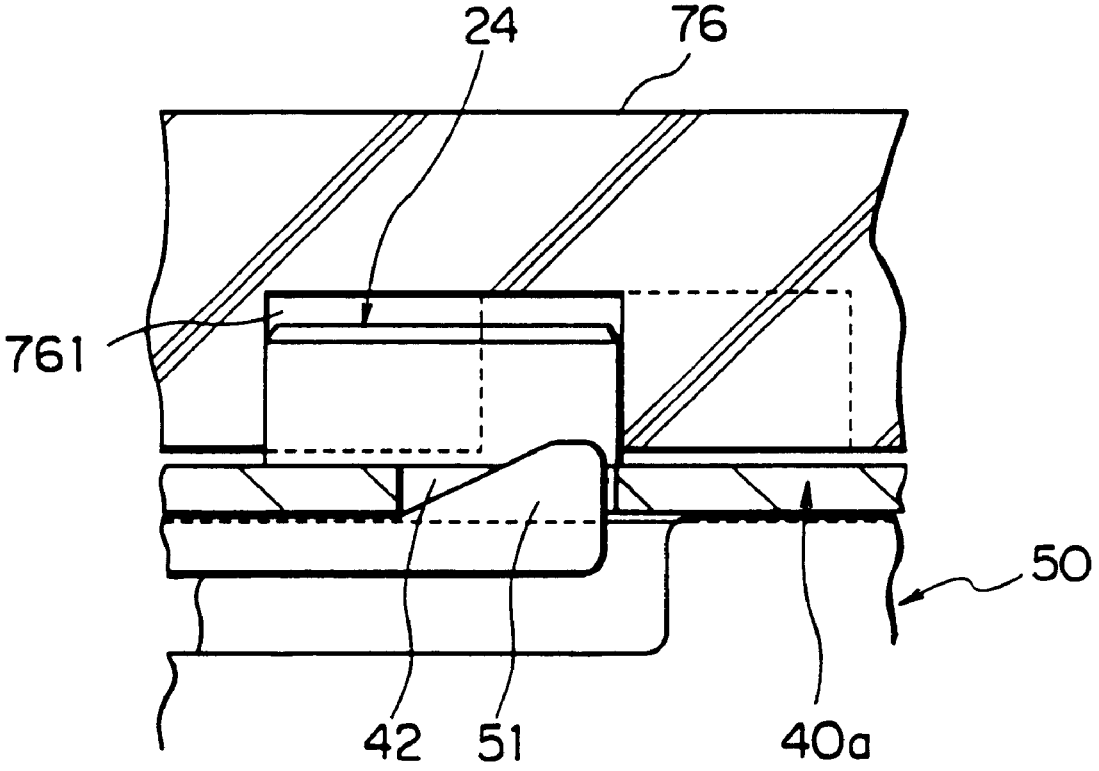
FIG. 8 is a partially enlarged view of a part enclosed by a circle in FIG. 7 for use in describing the relationship among a groove of the slider, a projection of the connector, an engaging hole of the housing, and an engaging projection of the partition.

Referring to FIGS. 7 and 8 as sectional views along the X-direction, the engagement portion 22 of the connector 20*a* is disconnected to pins of the mating connector 80 and, thereby, the connector 20*a* is separated from the mating connector 80. That is, the projection 24 and the first engaging projection 51 are all located in the groove 761 and, in particular, relative to the cam portion 762 on an opposite side of the slider block 72. Further, size of the projection 24 in the X-direction is substantially equal to the width of the groove 76 in the X-direction.

Figure 9:
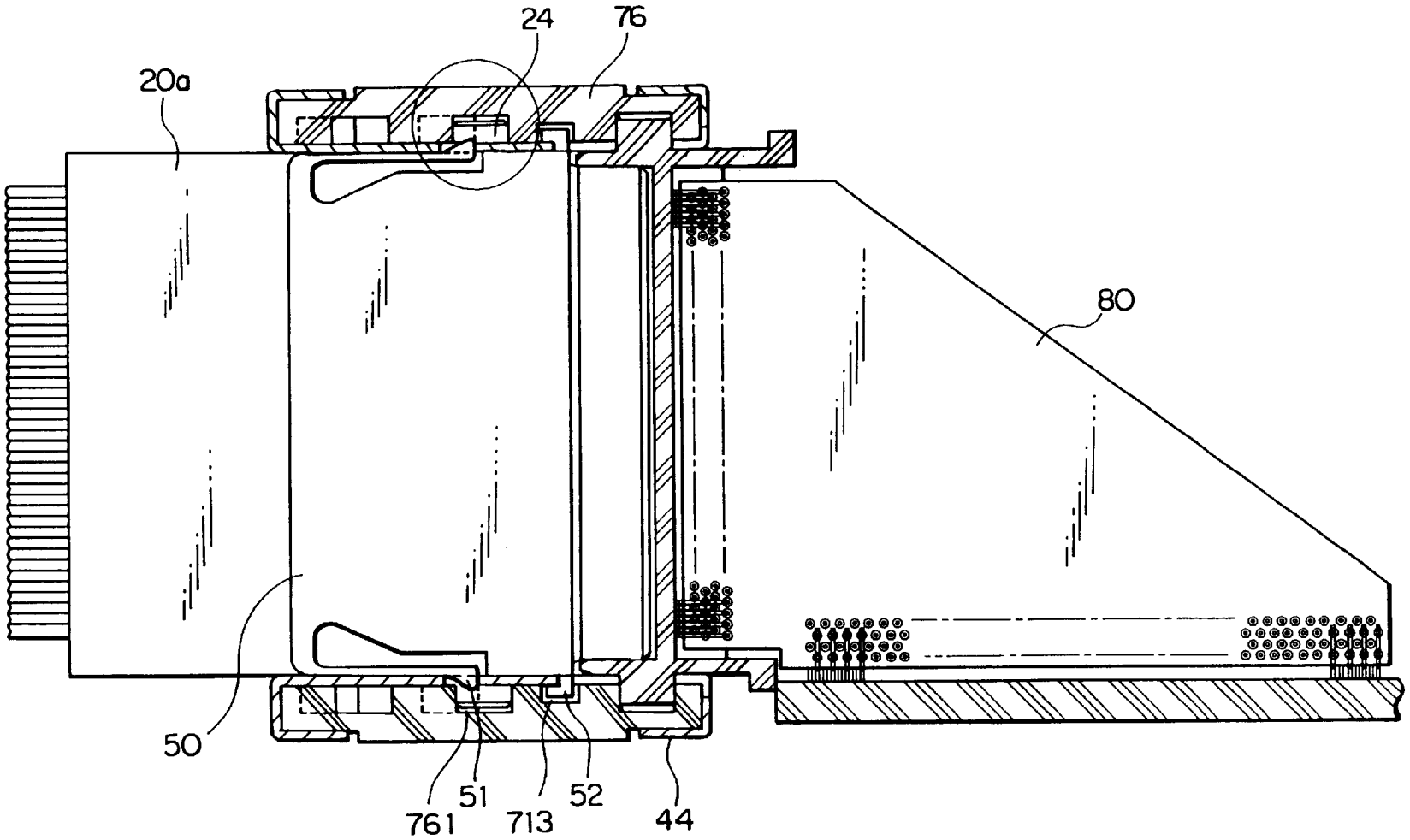
FIG. 9 is a sectional view similar to FIG. 7 but the connector is engaged with the mating connector.
Figure 10:
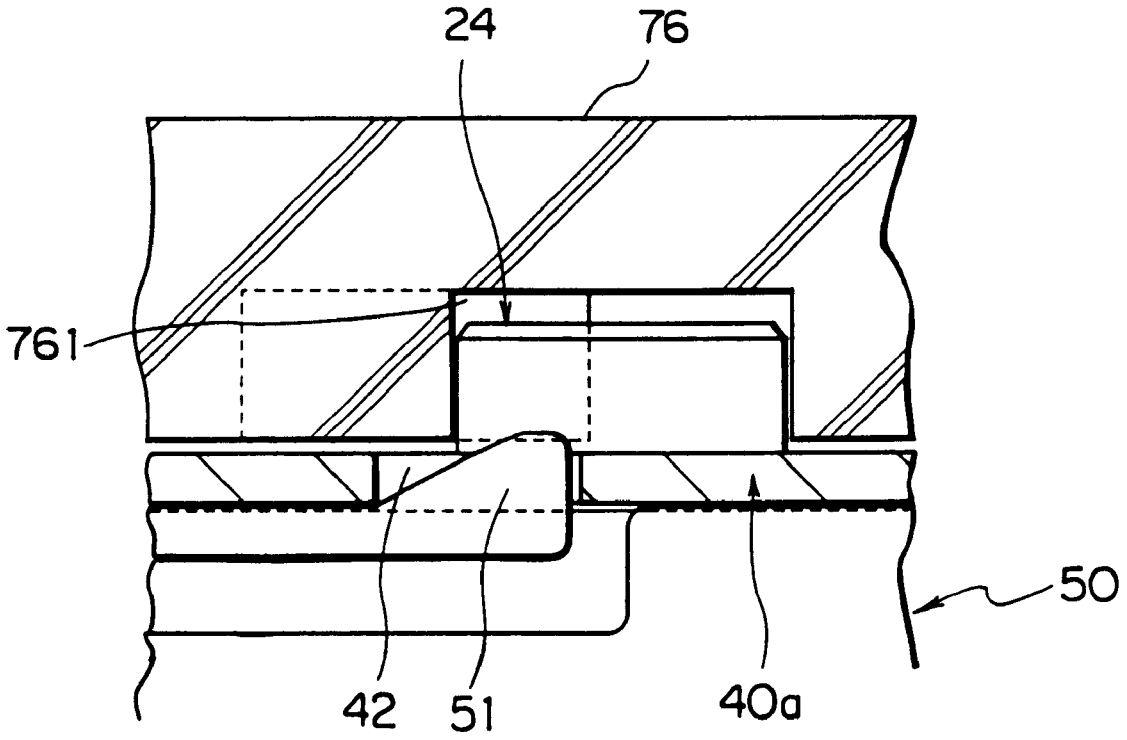
FIG. 10 is an enlarged view of the part enclosed by a circle in FIG. 9.

Under this condition, if the drawer 74 are operated and, thereby the slider member 70*a* are sliden in the Z-direction, for instance, a direction perpendicular to the drawing sheet, the connector driving apparatus of this invention drives the connector 20*a* relative to the mating connector 80 so that the connector 20*a* is engaged with the mating connector 80, as shown in FIGS. 9 and 10.

In FIGS. 9 and 10, it should be noted that the projection 24 and the first engaging projection 51 are all located in the groove 761 and, in particular, relative to the cam portion 762 on the same side of the slider block 72. Also, note that the size of the projection 24 in the X-direction is substantially equal to the width of the groove 76 in the X-direction, as same as the separated condition illustrated in FIGS. 7 and 8.

As clearly from the above description with FIGS. 7 through 10, in the present invention, the first engaging projection 51 is accommodated within the groove 761 at all time. Needless to say, other first engaging projection 51 not shown also do. In detail, the first engaging projection 51 (also the first hole 41) belongs to a range R of the X-direction, where the projection 24 can move, as illustrated in FIG. 11.

Figure 11:
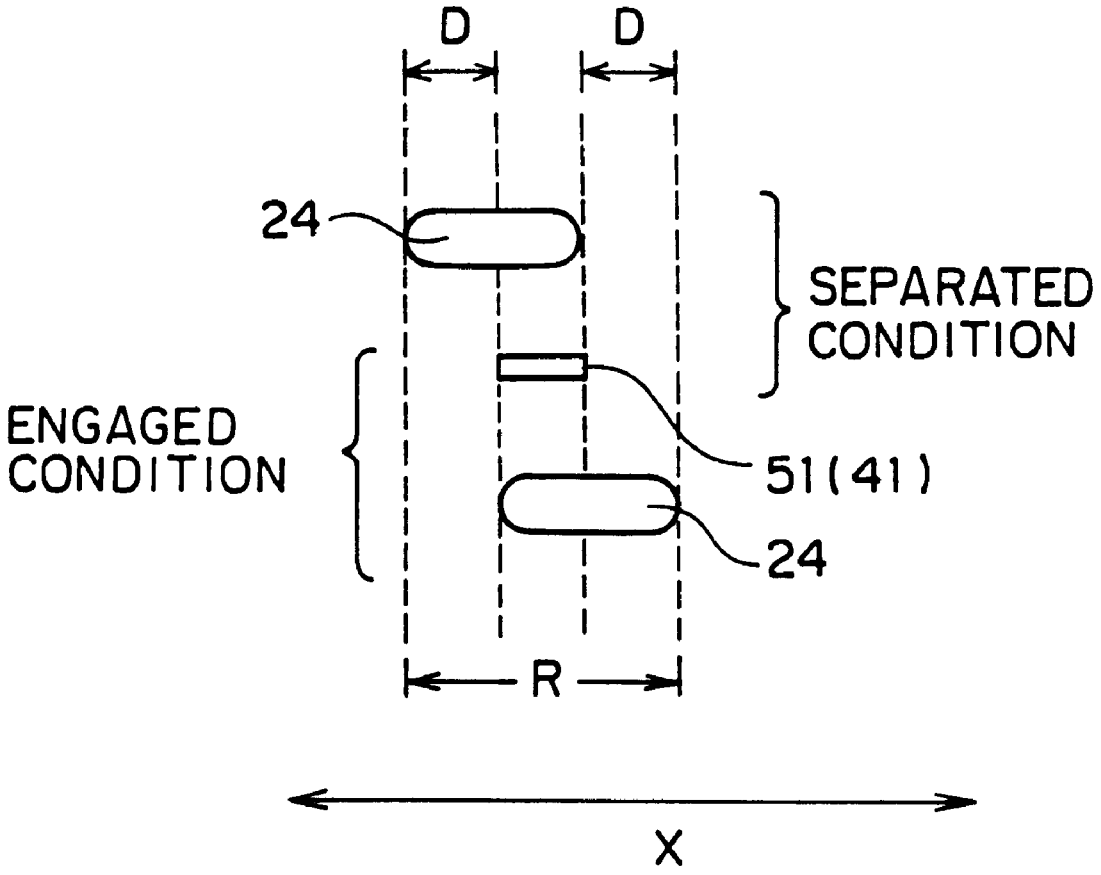
FIG. 11 is a view for describing a positional relationship between the projection of the connector and the first engaging projection of the partition in both conditions when the connector is separated from and engaged with the mating connector, respectively.

Also, the difference D between sizes of the projection 24 and of the first engaging projection 51 in the X-direction on a separated condition is equal to the difference D on an engaged condition, as shown in FIG. 11. This difference D depends on a minimum length necessary to connect and disconnect the engagement portion 22 of the connector 20*a* with the pins of the mating connector 80. That is, the difference D may be equal to any value longer than the minimum length but is preferably equal to the minimum length in order to achieve the best small-sized of the connector conventional apparatus.

With the above structure, since the groove 76 also serves for the first engaging slot of the conventional slider member, the slider member according to this invention has no engaging slot only for the first engaging projections 51 and, thereby, the connector driving apparatus can be totally small-sized in the X-direction without loss of the strength of the apparatus.

Figure 12:
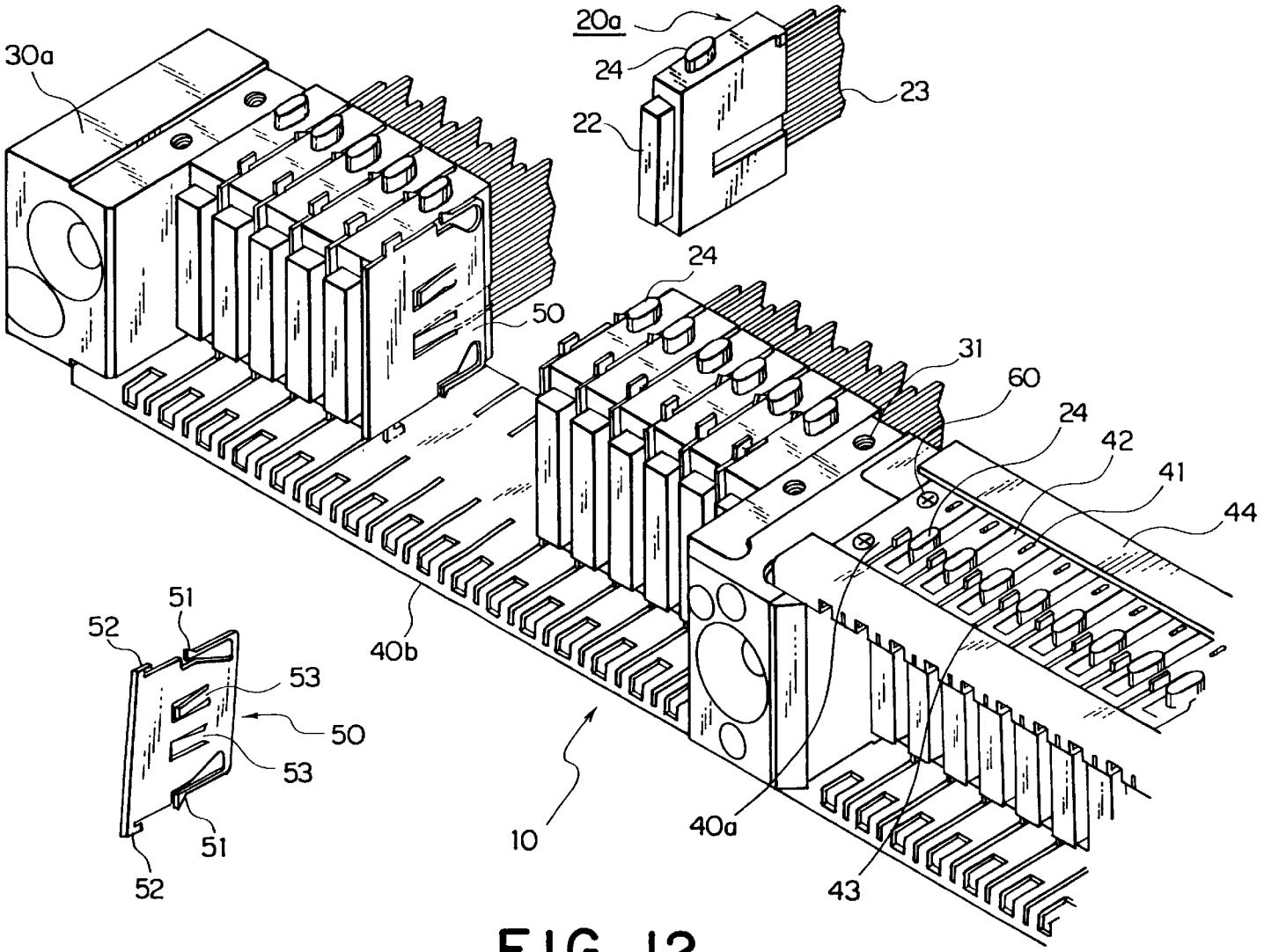
FIG. 12 is an enlarged perspective view of the housing and connectors of the apparatus of FIG. 4.

This effect according to this invention becomes conspicuous in case that the projection 24 of each connector 20*a* locates in each one of two positions in the X-direction when the plurality of connectors 20 are received in the housing 10, as illustrated in FIG. 12. In this event, each of the parallel slider plates 76 has two grooves 761*a* and 761*b* relative to two positions of the projection 24, respectively. On the other hand, accordingly to this invention, the connector driving apparatus does not require to have the first engaging slot of conventional techniques. Thus, the structure of this apparatus is superior to the known structure of the conventional apparatus. Besides, the tendency goes forward more and more, if the number of the positions arranged in the X-direction increases.

Figure 13:
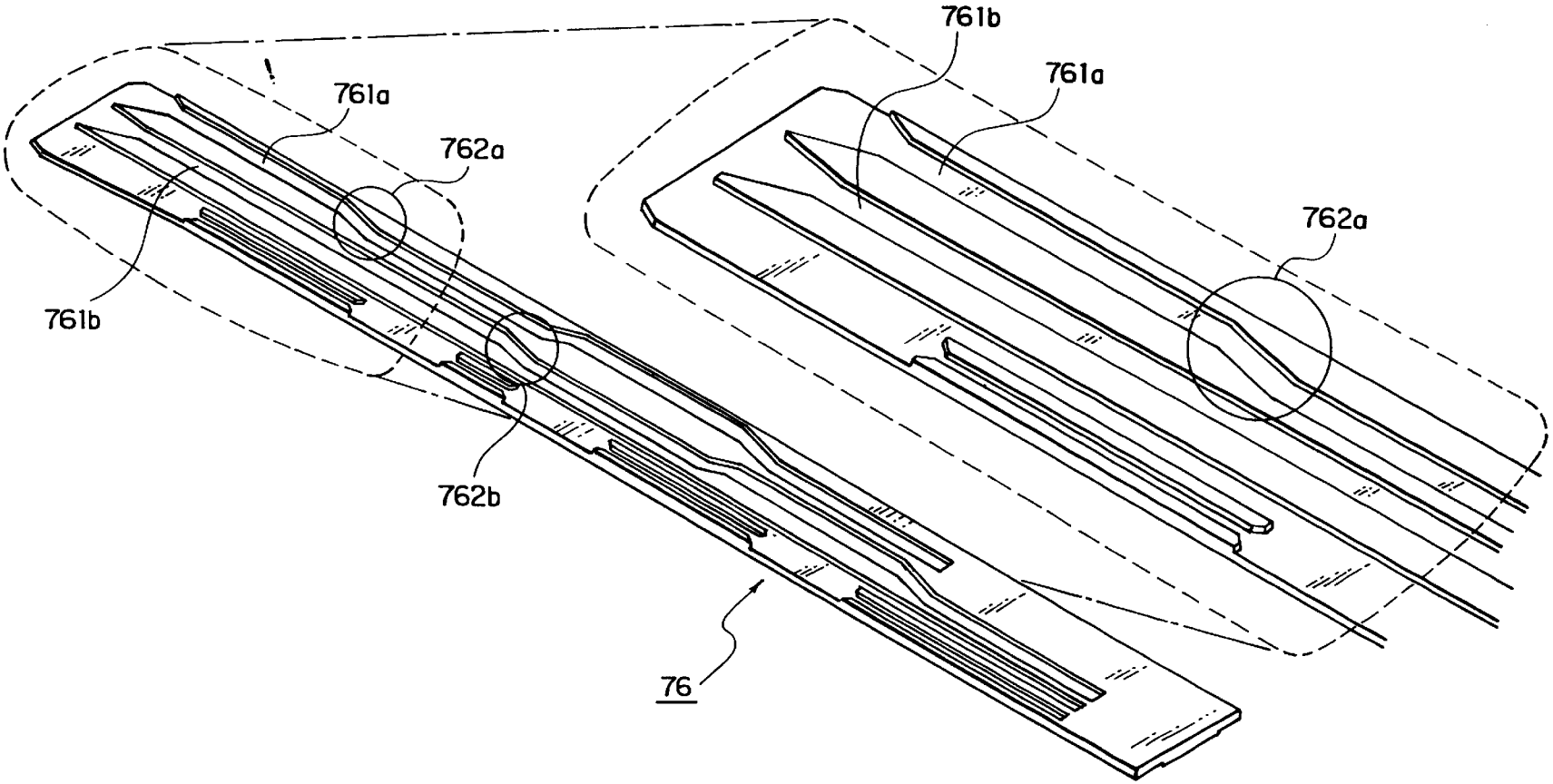
FIG. 13 shows an enlarged perspective view of the slider plate together with a further enlarged view of a main part enclosed by a dotted line in the enlarged perspective view, for use in describing a cam portion of the slider plate.

Moreover, the groove may have a plurality of the cam portions as illustrated in FIG. 13, in correspondence with the performance of the connectors. For instance, the connector driving apparatus copes with the two groups of the connectors 20*a*, as mentioned above with FIG. 4. It is assumed that each group further divided into a plurality of subgroups and the performance of connectors requires to be independent at every sub-groups. In this case, it is effective to have the plurality of the cam portions in order to move the sub-groups of the connectors 20*a* independently for each other. Herein, the groove mainly extends in the Z-direction and meanders in the X-direction.

What is claimed is:

1. A connector driving apparatus for driving a plurality of connectors relatively to a plurality of mating connectors in a first direction so as to perform connection and disconnection of the plurality of connectors with the plurality of mating connectors, each of the connectors having a projection outwardly projecting therefrom in a second direction perpendicular to the first direction, said apparatus comprising:

a housing adapted to fixedly hold therein the mating connectors which are arranged one by one in a third direction perpendicular to the first and second directions, the housing also being adapted to receive the connectors which are arranged one by one in the third direction so that the connectors are movable in the first direction relatively to the mating connectors, said housing comprising:

a pair of first and second parallel frames extending in the third direction and apart from each other in the second direction, the first parallel frame having a plurality of pairs of first and second holes, the pairs being located at predetermined positions spaced in the third direction, the first and second holes being spaced in the first direction, the first parallel frame further having a plurality of slits extending in the first direction, the slits being adapted to receive therein the projections of the connectors with parts of the projections of the connectors projecting through the slits and being adapted to permit the projections of the connectors to be moved in the first direction;

opposite side blocks arranged and adapted to fixedly connect the first and second parallel frames to each other at opposite ends of the first and second parallel frames in the third direction; and a plurality of partitions each of which has a pair of first and second engaging projections projecting on one side of the partition, the pair of first and second engaging projection engaged with a corresponding one of the pairs of first and second holes to fix a corresponding one of the partitions to the first parallel frame so that a space between the opposite side blocks within the housing is partitioned into a plurality of rooms which are arranged in the third direction to accommodate the plurality of connectors movable in the first direction; and a slider mounted on the first parallel frame and slidable in the third direction, the slider having a groove which extends in the third direction and which is adapted to receive the parts of the projections of the connectors projecting through the slits of the first parallel frame, the groove having a cam portion adapted to drive the projections of the connectors in the first direction when the slider is moved in the third direction so as to drive the connectors, the groove being in registry with the first holes of the first parallel frame and being adapted to also receive the first engaging projections projecting through the first holes; wherein each of the projections of the connectors has a particular cross section shape which is approximately an elliptical shape having a long axis in the first direction.

2. A connector driving apparatus as claimed in claim 1 wherein the groove has a predetermined width in the first direction substantially equal to the size of the projection in the first direction.

3. A connector driving apparatus as claimed in claim 1, wherein the groove has an additional cam portion at a point that is different from that of the cam portion so that the projections of the connectors are further driven in the first direction when the slider is moved in the third direction.

4. A connector driving apparatus as claimed in claim 1, further adapted to drive a plurality of additional connectors relatively to a plurality of additional mating connectors in the first direction so as to perform a connection and disconnection of the plurality of additional connectors with the plurality of additional mating connectors, each of the additional connectors having an additional projection which is outwardly projecting from each of the additional connectors toward the slider mounted on the first parallel frame in the second direction, the additional projection being located at a position which is different from a position of the projection of the connector in the first direction in a condition that the additional connectors and the connectors are connected with the additional mating connectors and the mating connectors, wherein:

the housing is also adapted to fixedly hold therein the additional mating connectors and is adapted to receive the additional connectors in the same manner for the mating connectors and the connectors;

the first parallel frame having a plurality of pairs of additional first and second holes, the pairs of the additional first and second holes being located at predetermined positions spaced in the third direction, the additional first and second holes being spaced in the first direction, the first parallel frame having a plurality of additional slits extending in the first direction, the additional slits being adapted to receive therein the additional projections of the additional connectors with parts of the additional projections of the additional connectors projecting through the additional slits and being adapted to permit the additional projections of the additional connectors to be moved in the first direction;

the housing further comprising a plurality of additional partitions each of which has a pair of additional first and second engaging projections on one side of the additional partition, the pair of the additional first and second engaging projections being engaged with a corresponding one of the pairs of the additional first and second holes in a same manner for the pair of the first and second engaging projections and the corresponding ones of the pairs of the first and second holes so that the additional partitions form a plurality of additional rooms in the space between the opposite side blocks within the housing and except for the plurality of the rooms, the plurality of additional rooms being arranged in the third direction and being adapted to accommodate the additional connectors which are movable in the first direction; and the slider further having an additional groove which corresponds to the additional projections of the additional connectors and which has an additional cam portion, the additional groove having the additional cam portion being adapted to drive the additional projections in the first direction in the same way that the groove having the cam portion drives the projections of the connectors.

5. A connector driving apparatus as claimed in claim 1, further comprising: an additional slider extending in the third direction and apart from the slider in the second direction; a slider block fixedly connecting the slider and the additional slider at one edge of each of the slider and the additional slider in the third direction; and the groove being located on a surface of the slider facing another surface of the additional slider.

6. A connector driving apparatus as claimed in claim 5, wherein each of the connectors has an opposite projection extending outwardly from an opposite side of the projection in the second direction, and the additional slider has another groove which faces the surface where the groove locates and which corresponds to the opposite projections, as same as the groove corresponding to the projections.

* * * * *

UNITED STATES PATENT AND TRADEMARK OFFICE

CERTIFICATE OF CORRECTION

PATENT NO. : 6,241,539 B1
DATED : June 5, 2001
INVENTOR(S) : Sato et al.

It is certified that error appears in the above-identified patent and that said Letters Patent is hereby corrected as shown below:

Column 1,
Line 67, after one insert -- . --

Column 2,
Line 10, delete "flame" and insert -- frame --
Line 13, delete "respetively" and insert -- respectively --
Line 17, delete "an" and insert -- and --
Line 17, delete "flame" and insert -- frame --
Line 31, delete "appaatus" and insert -- apparatus --

Column 3,
Line 32, delete "become"

Column 6,
Line 37, delete "40*d*" and insert -- 40*b* --
Line 52, delete "fist" and insert -- first --

Column 7,
Line 42, delete "76" and insert -- 761 --
Line 44, delete "sliden" and insert -- slid --
Line 55, delete "76" and insert -- 761 --

Signed and Sealed this

Twenty-third Day of April, 2002

*Attest:*

*Attesting Officer*

JAMES E. ROGAN
*Director of the United States Patent and Trademark Office*